US010892125B2

(12) United States Patent
Minowa et al.

(10) Patent No.: US 10,892,125 B2
(45) Date of Patent: Jan. 12, 2021

(54) ELECTROMAGNETIC RELAY

(71) Applicant: OMRON Corporation, Kyoto (JP)

(72) Inventors: Ryota Minowa, Kumamoto (JP); Shingo Mori, Kumamoto (JP)

(73) Assignee: Omron Corporation, Kyoto (JP)

( * ) Notice: Subject to any disclaimer, the term of this patent is extended or adjusted under 35 U.S.C. 154(b) by 138 days.

(21) Appl. No.: 16/131,764

(22) Filed: Sep. 14, 2018

(65) Prior Publication Data

US 2019/0131094 A1 May 2, 2019

(30) Foreign Application Priority Data

Oct. 31, 2017 (JP) ..... 2017-211101

(51) Int. Cl.
*H01H 50/54* (2006.01)
*H01H 50/04* (2006.01)
(Continued)

(52) U.S. Cl.
CPC ..... *H01H 50/54* (2013.01); *H01H 50/04* (2013.01); *H01H 50/045* (2013.01); *H01H 50/14* (2013.01); *H01H 50/18* (2013.01); *H01H 50/443* (2013.01); *H01H 50/546* (2013.01); *H01H 9/443* (2013.01); *H01H 50/38* (2013.01);
(Continued)

(58) Field of Classification Search
CPC ..... H01H 50/54; H01H 50/04; H01H 50/045; H01H 50/14; H01H 50/18
See application file for complete search history.

(56) References Cited

U.S. PATENT DOCUMENTS 7,911,301 B2 * 3/2011 Yano ..... H01H 9/443 335/131
2007/0241847 A1 10/2007 Yamamoto et al.
(Continued)

FOREIGN PATENT DOCUMENTS

CN 203644673 U 6/2014
EP 3139396 A1 3/2017
(Continued)

OTHER PUBLICATIONS

Chinese Office Action in corresponding Application No. 201811072956.7 dated Aug. 29, 2019 (14 pages).
(Continued)

*Primary Examiner* — Bernard Rojas
(74) *Attorney, Agent, or Firm* — Osha Bergman Watanabe & Burton LLP

(57) ABSTRACT

An electromagnetic relay is provided with a housing; a first fixed contact terminal and a second fixed contact terminal secured to the housing; a movable contact accommodated in a chamber in the housing; a movable shaft with one end connected to the movable contact, and a solenoid configured to drive the movable shaft in a contact movement direction. The solenoid includes: a spool with a through-hole in the drum; a fixed armature secured in the through-hole; and a movable armature arranged between the fixed armature in the through-hole and an insulating wall; the movable armature is configured to travel with the movable shaft between an operation position and a return position. The housing includes an alignment part that determines the return position of the movable armature.

2 Claims, 11 Drawing Sheets

(51) Int. Cl.

| | |
|---|---|
| ***H01H 9/44*** | (2006.01) |
| ***H01H 50/14*** | (2006.01) |
| ***H01H 50/18*** | (2006.01) |
| ***H01H 50/44*** | (2006.01) |
| *H01H 50/22* | (2006.01) |
| *H01H 50/38* | (2006.01) |

(52) U.S. Cl.
CPC . *H01H 2050/225* (2013.01); *H01H 2050/446* (2013.01)

(56) References Cited

U.S. PATENT DOCUMENTS

| | | | | |
|---|---|---|---|---|
| 2009/0096559 | A1* | 4/2009 | Yano | H01H 9/443 335/187 |
| 2014/0092517 | A1* | 4/2014 | Sora | H01H 50/44 361/160 |
| 2015/0054605 | A1* | 2/2015 | Kubono | H01H 50/60 335/177 |
| 2015/0213984 | A1 | 7/2015 | Naka et al. | |
| 2017/0069452 | A1 | 3/2017 | Hiroki et al. | |

FOREIGN PATENT DOCUMENTS

| | | | |
|---|---|---|---|
| JP | 2004-022444 | A | 1/2004 |
| JP | 2014-099373 | A | 5/2014 |
| JP | 6110109 | B2 | 4/2017 |
| WO | 2006/104080 | A1 | 10/2006 |

OTHER PUBLICATIONS

Notice of Reasons for Refusal issued in Japanese Application No. 2017-211101, dated Oct. 27, 2020 (8 pages).

* cited by examiner

ELECTROMAGNETIC RELAY

FIELD

The present disclosure relates to an electromagnetic relay.

BACKGROUND

Japanese Patent No. 6110109 discloses contactor device provided with a pair of fixed contacts and a movable contact. The fixed contacts are electrically isolated from each other, and the movable contact forms a square plate that makes contact with and separates from the pair of fixed contacts. Each of the fixed contacts of the pair provided to the contactor device includes a supporting conductive portion and a C-shaped portion. The supporting conductive part is secured to a fixed-contact insulating base-plate in a device housing. The C-shaped portion connects to the end of the supporting conductive portion inside the device housing. Each C-shaped portion is made up of an upper portion, a lower portion, and an intermediate portion. The lower portion is opposite the upper portion which connects to the supporting conductive portion, and the intermediate portion connects the upper and lower portions. A contact point is provided on surface of the lower portion facing the upper portion. Both lengthwise ends of the movable contact sit between the upper and lower plates of the C-shaped portions facing the contacts.

The contactor device also includes a connecting shaft connected therein at the lengthwise center of the movable contact. The connecting shaft extends in the direction of closure and separation for the pair of fixed contacts; on one end of this extending direction the connecting shaft passes through an insulating tube provided opposite the fixed-contact insulating base-plate from inside to outside the device housing. The movable plunger of an electromagnet unit is attached to the end of the connecting shaft outside the device housing. The movable plunger moves along the closure and separation direction based on the excitation state of the electromagnet unit.

Technical Problem

An auxiliary yoke is provided between the insulating tube and the movable plunger in the contactor device. The auxiliary yoke determines the return position of the movable plunger. In other words, the auxiliary yoke determines the position of the movable plunger when the movable contact is furthest from the contacts. However, given that the insulating tube as well as the accuracy in the dimensions or position of the auxiliary yoke also affects the return position of the movable plunger in the contactor device, it tends to be difficult to very precisely control the position of the movable plunger in relation to the storage case.

The present disclosure describes an electromagnetic relay that allows for highly accurate positioning of the movable armature in relation to the housing.

SUMMARY

An electromagnetic relay according to an embodiment of the present invention includes:

An electromagnetic relay comprising: a housing including a first compartment and a second compartment mutually separated by an insulating wall;

a first fixed contact terminal secured to the housing and extending from outside the housing to the first compartment, the first fixed contact terminal including a first fixed contact point in the first compartment;

a second fixed contact terminal secured to the housing and extending from outside the housing to the first compartment, the second fixed contact terminal electrically isolated from the first fixed contact terminal and including a second fixed contact point in the first compartment;

a movable contact arranged in the first compartment, and including a first movable contact point and a second movable contact point, the first and second movable contact points facing the first and second fixed contact points which are arranged between the first and second movable contact points and the insulating wall; the first and second movable contact points configured to travel in a contact movement direction in which the first and second movable contact points make contact with and separate from the first and second fixed contact points;

a movable shaft extending from the first compartment to the second compartment in the contact movement direction with one end in the extension direction arranged in the first compartment and the other end in the extension direction arranged in the second compartment via a through-hole that passes through the insulating wall in the contact movement direction, the one end in the extension direction connected to the movable contact in the first compartment and configured to travel together with the movable contact in the contact movement direction; and a solenoid in the second compartment configured to drive the movable shaft in the contact movement direction;

the solenoid including:

a spool that includes: a through-hole extending in the contact movement direction and accommodating the other end of the movable shaft, a coil, and a drum with the coil wrapped around the drum in the contact movement direction;

a fixed armature secured in the through-hole to the far end of the through-hole relative to the insulating wall in the contact movement direction;

a movable armature arranged in the through-hole between the fixed armature and the insulating wall and attached to the other end of the movable shaft, the movable armature configured to travel with the movable shaft in the contact movement direction between an operation position and a return position;

the housing including:

an alignment part provided in the second compartment 112 at the insulating wall (FIG. 3), the alignment part defining the return position of the movable armature.

Effects

An alignment part is provided at the insulating wall in the second compartment in the housing of the electromagnetic relay; the alignment part determines the return position of the movable armature. That is, the movable armature can be accurately position in relation to the housing by maintaining the accuracy of the dimensions of the insulating wall in the housing. Therefore, compared to Japanese Patent No. 6110109 where the accuracy in the dimensions or positioning of the insulating tube and the auxiliary yoke also affects the return position of the movable plunger, the movable armature can be very accurately positioned in the housing.

DETAILED DESCRIPTION

An embodiment of the invention is described with reference to the attached drawings. Note that, while terms representing specific directions and positions (such as, terms including "up", "down", "right", and "left") are used in the following description, the use of these terms are merely for facilitating an understanding of the invention with reference to the drawings. The meanings of these terms are not intended to limit the technical scope of the present invention. The following description merely provides an example, and is not intended to limit the present invention, where the invention is to be adopted, or how the invention is to be used. Moreover, the drawings provided are schematic and are not intended to indicate a scale for actual measurements.

Figure 1:
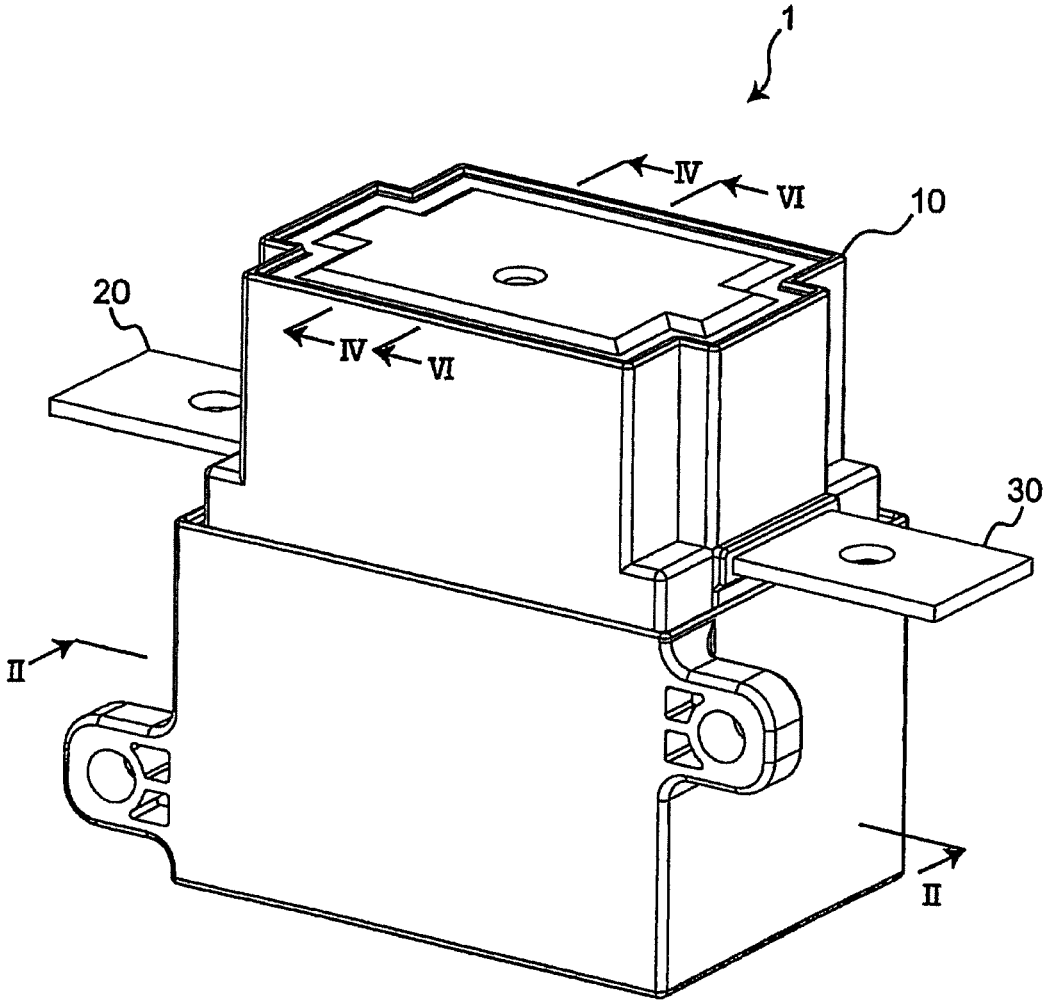
FIG. 1 is a perspective view of an embodiment of an electromagnetic relay according to the present invention.

An electromagnetic relay according to an embodiment of the present invention is provided with a housing 10, a first fixed contact terminal 20 and a second fixed contact terminal 30 as illustrated in FIG. 1. The first and second fixed contact terminals 20, 30 are secured in the housing 10 and are electrically isolated from each other.

Figure 2:
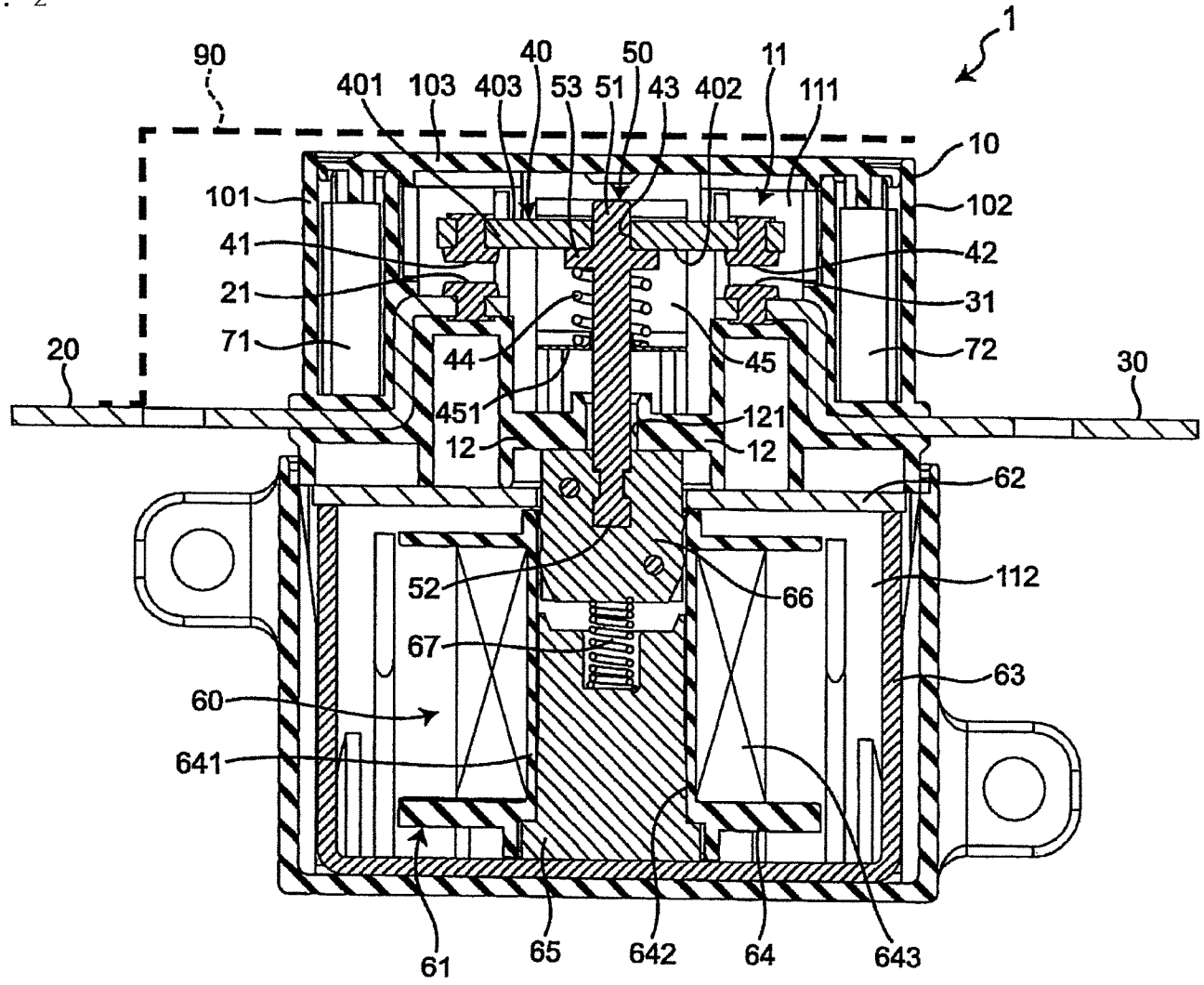
FIG. 2 is a cross-sectional view along the line II-II.

Provided inside the housing 10 is a chamber 11 as illustrated in FIG. 2. A movable contact 40, which includes a first movable contact point 41 and a second movable contact point 42, a movable shaft 50 connected on one end to the movable contact 40, and a solenoid 60 that drives the movable shaft 50 are all located in the chamber 11.

The housing 10 includes a box-like truncated rectangle (FIG. 1) wherein an insulating wall 12 partitions the chamber 11 along the length of the housing 10. That is, the insulating wall 12 partitions the chamber 11 along the length of the housing 10 to create a first compartment 111 and a second compartment 112 parallel to each other.

The flat first fixed contact terminal 20 is disposed in one direction connecting the first movable contact point 41 and the second movable contact point 42 in the housing 10 (FIG. 2, i.e., from left to right and referred to below as the arrangement direction). The first fixed contact terminal 20 extends from outside the housing 10 into the first compartment 111 and is secured to a first wall 101 that extends along the length of the housing 10. The end of the first fixed contact terminal 20 near the first compartment 111, i.e., the right end in FIG. 2 includes a first fixed contact point 21 arranged in the first compartment 111.

The flat second fixed contact terminal 30 is disposed along the arrangement direction in the other direction in the housing 10 (FIG. 2). The second fixed contact terminal 30 extends from outside the housing 10 into the first compartment 111 and is secured to a second wall 102 that extends along the length of the housing 10. The second fixed contact terminal 30 is electrically isolated from the first fixed contact terminal 20. The end of the second fixed contact terminal 30 near the first compartment 111, i.e., the left end in FIG. 2, includes a second fixed contact point 31 arranged in the first compartment 111.

The first and second fixed contact points 21, 31 face the first and second movable contact points 41, 42 of the movable contact 40 inside the first compartment 111. The first and second fixed contact points 21, 31 are also located between the first and second movable contact points 41, 42 and the insulating wall 12. The first and second fixed contact points 21, 31 are substantially orthogonal to the first and second walls 101, 102 lengthwise of the housing 10 (i.e., vertically, FIG. 2). The first and second walls 101, 102 are substantially equidistant from a third wall 103; the first, second, and third walls 101, 102, 103 together with the insulating wall 12 create the first compartment 111.

As illustrated in FIG. 2, the movable contact 40 is configured to move along the length of the housing 10 between the first and second fixed contact points 21, 31 and the third wall 103 of the housing 10. The movable contact 40 includes a substantially rectangular contact body 401, a coil spring 44 connected to the contact body 401 and a coil spring retainer 45 for holding the coil spring 44.

The contact body 401 includes a first flat surface 402 that is opposite the first and second fixed contact points 21, 31, and a second flat surface 403 that is opposite the third wall 103 of the housing 10. The first and second movable contact points 41, 42 are separate from each other on the first flat surface 402 along the length of the movable contact 40 and face the first and second fixed contact points 21, 31 respectively. The contact body 40 includes a through-hole 43 (which is an example of a connection hole) at substantially the center lengthwise of the movable contact 40, i.e., laterally in FIG. 2, passing through in the thickness direction, i.e., vertically in FIG. 2. One end of the movable shaft 50 is connected to the contact body 401 and passes through the through-hole 43. The one end of movable shaft 50 travels relative to the contact body 401 along the thickness thereof.

The coil spring retainer 45 includes a first brim-like holder 451 disposed between the contact body 401 and the insulating wall 12 in the direction the first and second movable contact points 41, 42 contact with and separate from the first and second fixed contact points 21, 31 (i.e., lengthwise of the housing 10, and referred to below as the contact movement direction); the first holder 451 is connected to the contact body 401. The flat surface of the first holder 451 faces the contact body 401 and is orthogonal to the movable shaft 50.

The coil spring 44 is in the first compartment 111 between the movable contact 40 and the insulating wall 12 in the contact movement direction to bias the first and second movable contact points 41, 42 toward the first and second fixed contact points 21, 31 opposite thereto. The coil spring 44 is held by the first holder 451 in the coil spring retainer 45 for the movable contact 40, and a later-described second holder 53 on the movable shaft 50. In this embodiment the coil spring 44 is held compressed.

The movable shaft 50 is a roughly circular column extending in the contact movement direction from the first compartment 111 to the second compartment 112. A first end 51 of the movable shaft 50 in the extension direction is in the first compartment 111 while another second end 52 in the extension direction is in the second compartment 112 via a through-hole 121 in the insulating wall 12. The first end 51 of the movable shaft 50 connects to the movable contact 40 in the first compartment 111 and is configured to travel with the movable contact 40 in the contact movement direction.

The second, also brim-like holder 53 is provided at the first end 51 of the movable shaft 50. The second holder 53 is located between the contact body 401 of the movable contact 40 and the first holder 451 in the coil spring retainer 45. The second holder 53 extends in a direction intersecting with (e.g., orthogonal to) the extending direction of the movable shaft 50 and together with the first holder 451 holds the coil spring 44.

The solenoid 60 is made up of an electromagnet 61 that extends in the contact movement direction, a substantially rectangular and flat first yoke 62, a substantially U-shaped second yoke 63, a fixed armature 65, and the movable armature 66 (FIG. 2). The first yoke 62 extends in the arrangement direction along the insulating wall 12; the second yoke 63 together with the first yoke 62 wraps around the electromagnet 61 in a direction orthogonal to the contact movement and the arrangement directions (i.e., a direction passing through the FIG. 2). The fixed armature 65 is connected to the second yoke 63; and the movable armature 66, which is connected to the second end 52 of the movable shaft 50, is configured to travel in the contact movement direction relative to the fixed armature 65. The solenoid 60 drives the movable shaft 50 in the contact movement direction when the electromagnet 61 is energized.

The electromagnet 61 extends in the contact movement direction and includes a spool 64. The spool 64 includes a drum 641 with a through-hole 642 that can accommodate the second end 52 of the movable shaft 50. The drum 641 in the spool 64 includes a coil 641 wound therearound in the contact movement direction.

The fixed armature 65 is secured in the through-hole 642 of the drum 641 with the end part thereof away from the insulating wall 12 along the contact movement direction connected to the second yoke 63. The movable armature 66 is situated between the fixed armature 65 in the through-hole 642 in the drum 641 and the insulating wall 12; the second end 52 of the movable shaft 50 is connected to the movable al mature 66 so that the movable armature 66 travels with the movable shaft 50 in the contact movement direction. Additionally, a return spring 67 is provided between the fixed armature 65 and movable armature 66 in the through-hole 642; the return spring 67 biases the movable armature 66 along the contact movement direction towards the insulating wall 12.

As illustrated in FIG. 2, when the electromagnet 61 is not energized the return spring 67 biases the movable armature 66 in the contact movement direction so that the movable armature 66 approaches the insulating wall 12, and the insulating wall 12 limits the movement of the movable armature 66 in the contact movement direction. The movable contact 40 is also the furthest from the insulating wall 12 in the contact movement direction when the movable armature 66 is at the return position, and the first and second movable contact points 41, 42 are separated from the first and second fixed contact points 21, 31 opposite thereto.

Once the electromagnet 61 is energized, the movable armature 66 travels towards the fixed armature 65 along the contact movement direction in opposition to the biasing force of the return spring 67. The movable contact 40 travels towards the insulating wall 12 along the contact movement direction with the movement of the movable armature 66, and the first and second movable contact points 41, 42 contact the first and second fixed contact points 21, 31 opposite thereto. At this point the movable armature 66 is at an operating position where the movable armature 66 is limited in how far the same moves away from the insulating wall 12 in the contact movement direction.

That is, the solenoid 60 in the electromagnetic relay 1 is configured so that the movable armature 66 can travel between a return position and an operation position along the contact movement direction. The solenoid 60 is also configured so that the direction the movable contact 40 approaches the solenoid 60 is the same as the direction along which the movable armature 66 travels from the operation position to the return position (i.e., the direction the separated movable contact points 41, 42 approach and contact the corresponding fixed contact points 21, 31).

The first compartment 111 in the housing 10 also include a pair of permanent magnets 71, 72 provided in the arrangement direction sandwiching the movable contact 40. The permanent magnets 71, 72 are situated between the first wall 101 and first fixed contact terminal 20 and the second wall 102 and the second fixed contact terminal 30 respectively in the housing 10.

Next, the first fixed contact terminal 20, the second fixed contact terminal 30, and the movable contact 40 are described in further detail with reference to FIG. 3.

Figure 3:
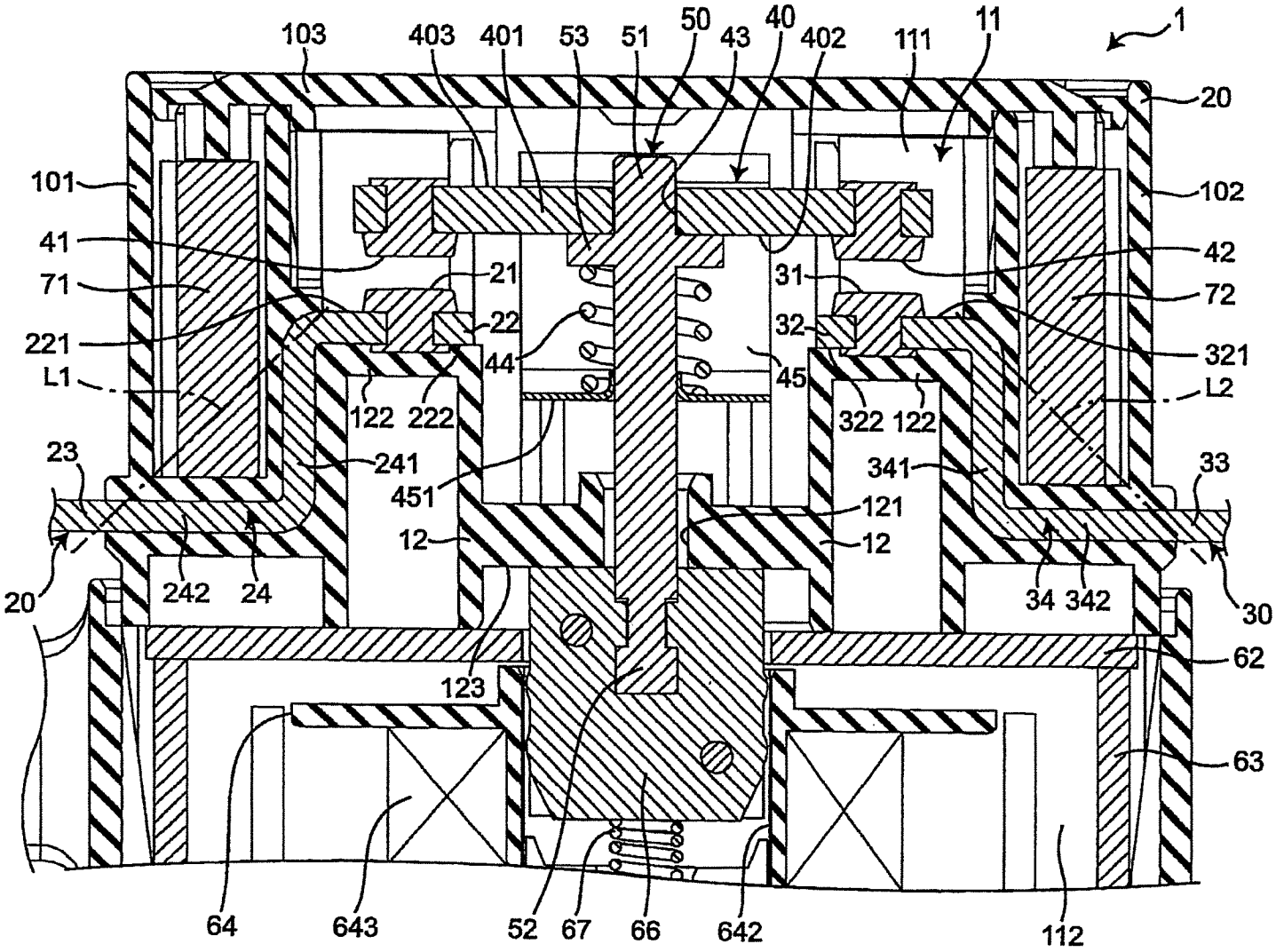
FIG. 3 is a partial magnified view of the first compartment in the cross section illustrated in FIG. 2.

As illustrated in FIG. 3, the first fixed contact terminal 20 and second fixed contact terminal 30 include a contact arrangement portion 22, 32 respectively, an external contact 23, 33, and an intermediate portion 24, 34. The contact arrangement portion 22, 32 is situated in the first housing compartment 111 and holds a fixed contact point 21, 31. An external terminal 23, 33 is situated outside the housing 10 in a direction intersecting contact movement direction (in this embodiment in the arrangement direction); the intermediate portion 23, 33 connects the contact arrangement portion 22, 32 and the external contact 23, 33 Note that the fixed contact terminals 20, 30 are made up of a single conductive material, and the contact arrangement portions 22, 32, the external terminals 23, 33, and the intermediate portions 24, 34 are integrally formed.

More specifically, the contact arrangement portions 22, 32 each extended arrangement direction with the first fixed contact points 21 where the second fixed contact 30 arranged thereon to 31; the contact arrangement portions 22, 32 each includes a contact arrangement surface 221, 321 facing the first flat surface 402 on the movable contact 40 and a support surface 222, 322 opposite the contact arrangement surface 222, 322 along the contact movement direction.

As illustrated in FIG. 2, the electromagnetic relay 1 has a symmetrical internal structure about the movable shaft 50 when viewed from a direction orthogonal to the contact movement direction and the arrangement direction (a direction passing through the FIG. 2). That is, the support surface 222, 322 on the contact arrangement portions 22, 32 are at substantially the same position on a plane orthogonal to the movable shaft 50.

The external terminals 23, 33 are closer to the second compartment 112 in the contact movement direction than the contact arrangement portions 22, 32; the external terminals 23, 33 extend in mutually opposite directions from the first and second walls 101, 102 of the housing 10.

The intermediate portions 24, 34 are L-shaped and each curve near the second compartment 112 relative a virtual line L1, L2 that connects both ends in the direction the intermediate portions 24, 34 extend. That is, an intermediate portion 24, 34 is made up of a vertical part 241, 341 (e.g., a first vertical part and a second vertical part) and a horizontal part 242, 342 (e.g., a first horizontal part and a second horizontal part). The vertical part 241, 341 extends from the far end of the contact arrangement portion 22, 32 relative the movable shaft 50 in the arrangement direction and away from the movable contact 40 in the contact movement direction. Note that the housing 10 retains the intermediate portions 24, 34 in the electromagnetic relay 1.

That is, the pair of permanent magnets 71, 72 is located between the first and second walls 101, 102 in the housing 10 and the vertical parts 241, 341 of the intermediate portions 24, 34 in the arrangement direction, and between the third wall 103 and the horizontal parts 242, 342 of the intermediate portions 24, 34 in the contact movement direction. In other words, the permanent magnets 71, 72 are between the housing 10 and the intermediate portion 24 of the first fixed contact terminal 20, and between the housing 10 and the intermediate portion 34 of the second fixed contact terminal 30 respectively.

Note that the first and second fixed contact terminals 20, 30 may be secured to the housing 10 using a method such as inset molding; alternatively, the housing 10 may be molded with a groove into which the fixed contact terminals 20, 30 may be press-fitted, and the fixed contact terminals 20, 30 press-fitted thereto. A through-hole may be provided along the thickness of the fixed contact terminals 20, 30 and the intermediate portions 24, 34 when the fixed contact terminals 20, 30 are inset molded into the housing 10; hereby, the contact terminals 20, 30 may be more reliably secured to the housing 10.

The insulating wall 12 of the housing 10 extends in the arrangement direction between the first wall 101 and the second wall 102 with a through-hole 121 in the middle (FIG. 3).

The insulating wall 12 includes a pair of supports 122 near the first compartment 111. The supports 122 each supports a contact arrangement portion 22, 32 for the first or second fixed contact point 21, 31 of the first or second fixed contact terminal 20, 30 respectively. The supports 122 are in the middle between the through-hole 121 in the insulating wall 12 and the first wall 101 and in the middle between the through-hole 121 in the insulating wall 12 and the second wall 102. The supports 122 extend along the vertical parts 241, 341 of the intermediate portions 24, 34 for the fixed contact terminals 20, 30 up to the support surfaces 222, 322 on the contact arrangement portions 22, 32 to support substantially the entire support surfaces 222, 322 of the contact arrangement portions 22, 32. That is, a support 122 supports the first or second fixed contact point 21, 31 on the contact arrangement portion 22, 32.

Figure 4:
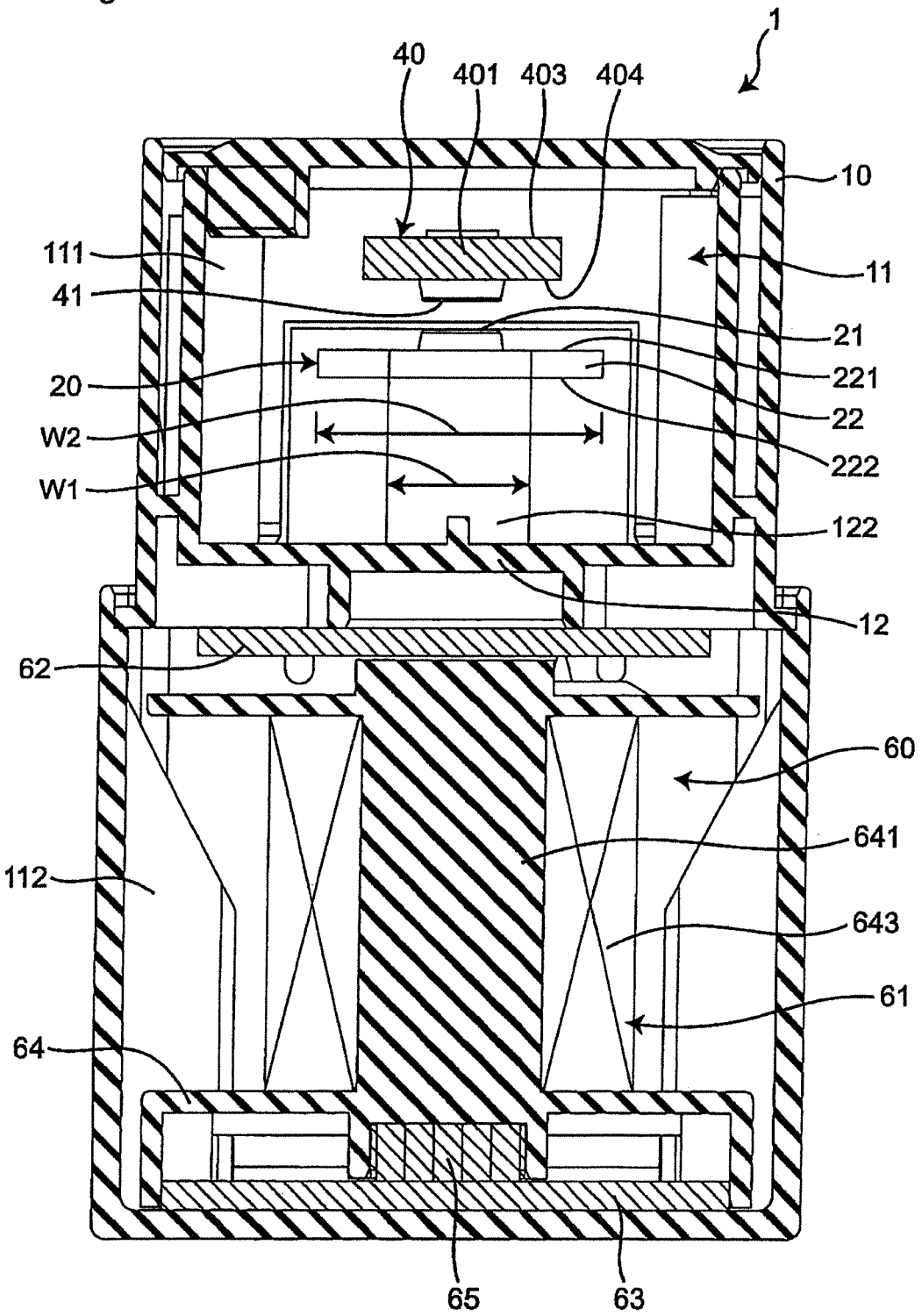
FIG. 4 is a cross-sectional view along the line IV-IV.

As illustrated in FIG. 4, the supports 122 are made so that width W1 in the direction orthogonal to the contact movement direction and the arrangement direction, i.e., the length left to right in FIG. 4, is less than the width W2 of the contact arrangement portion 22, 32 of the first or second fixed contact terminal 20, 30; in other words W1<W2. Note that only the contact arrangement portions 22 for the first fixed contact terminal 20 is depicted in FIG. 4. This reduces deterioration of the supports 122 due to the arc generated when the movable contact points 41, 42 contact with or separate from the fixed contact points 21, 31.

An alignment part 123 is provided in the second compartment 112 at the insulating wall 12 (FIG. 3); the alignment part 123 determines the return position of the movable armature 66. The alignment part 123 is located between the pair of supports 122 surrounding the through-hole 121 in the insulating wall 12; the alignment part 123 is roughly orthogonal to the movable shaft 50 is flat to allow the movable armature 66 to make contact therewith. That is, the alignment part 123 is a flat surface that is a part of the housing 10 and is provided near the second compartment 112 created by the insulating wall 12.

Note that the movable armature 66 makes contact with the alignment part 123 but does not cover the through-hole 121 in the insulating wall 12 when at its return position (FIG. 3) in the electromagnetic relay 1. That is, the first compartment 111 and the second compartment 112 are fluidly connected even when the movable armature 66 is in contact with the alignment part 123.

Figure 5:
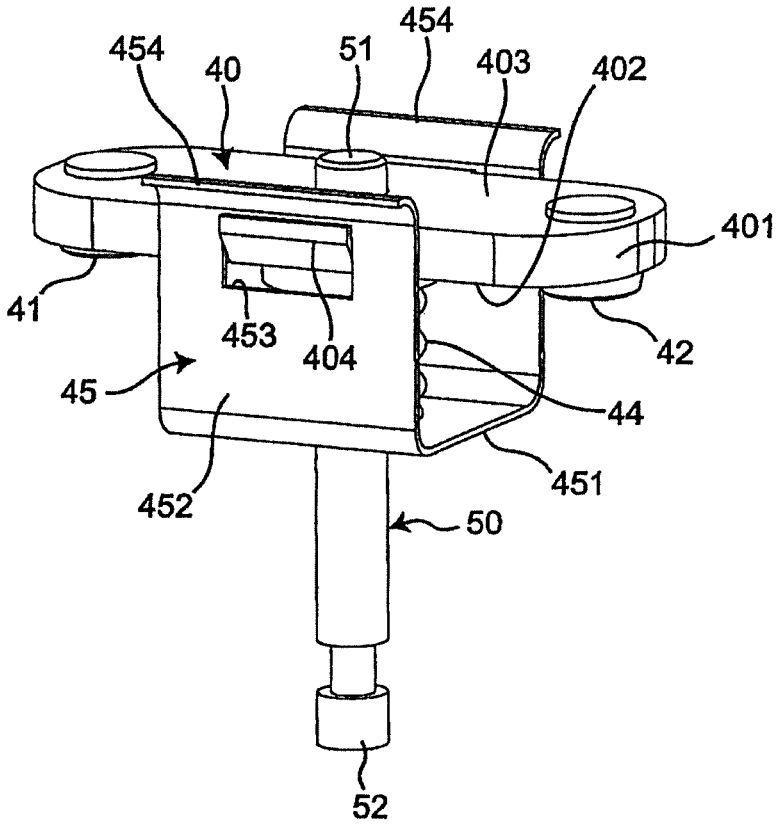
FIG. 5 is a perspective view of the movable contact and the movable shaft in the electromagnetic relay in FIG. 1.

The coil spring retainer 45 and the contact body 401 in the movable contact 40 are provided separately as illustrated in FIG. 5. The contact body 401 and the first holder 451 in the coil spring retainer 45 are connected by a pair of substantially rectangular plate-like connectors 452. In other words, the coil spring retainer 45 appears U-shaped when viewed along the length of the contact body 401. The connectors 452 appear situated at the middle along the length of the contact body 401 and extend from each end along the width (i.e., each end of the short side) of the contact body 401 toward the insulating wall 12 (i.e., toward the second end 52 of the movable shaft 50) with the flat surfaces thereof mutually parallel; note that the width of the contact body 401 intersects the arrangement direction. The ends 454 of the connector 452 near the contact body 401 along the contact movement direction curve away from each other toward the width direction of the contact body 401.

Figure 6:
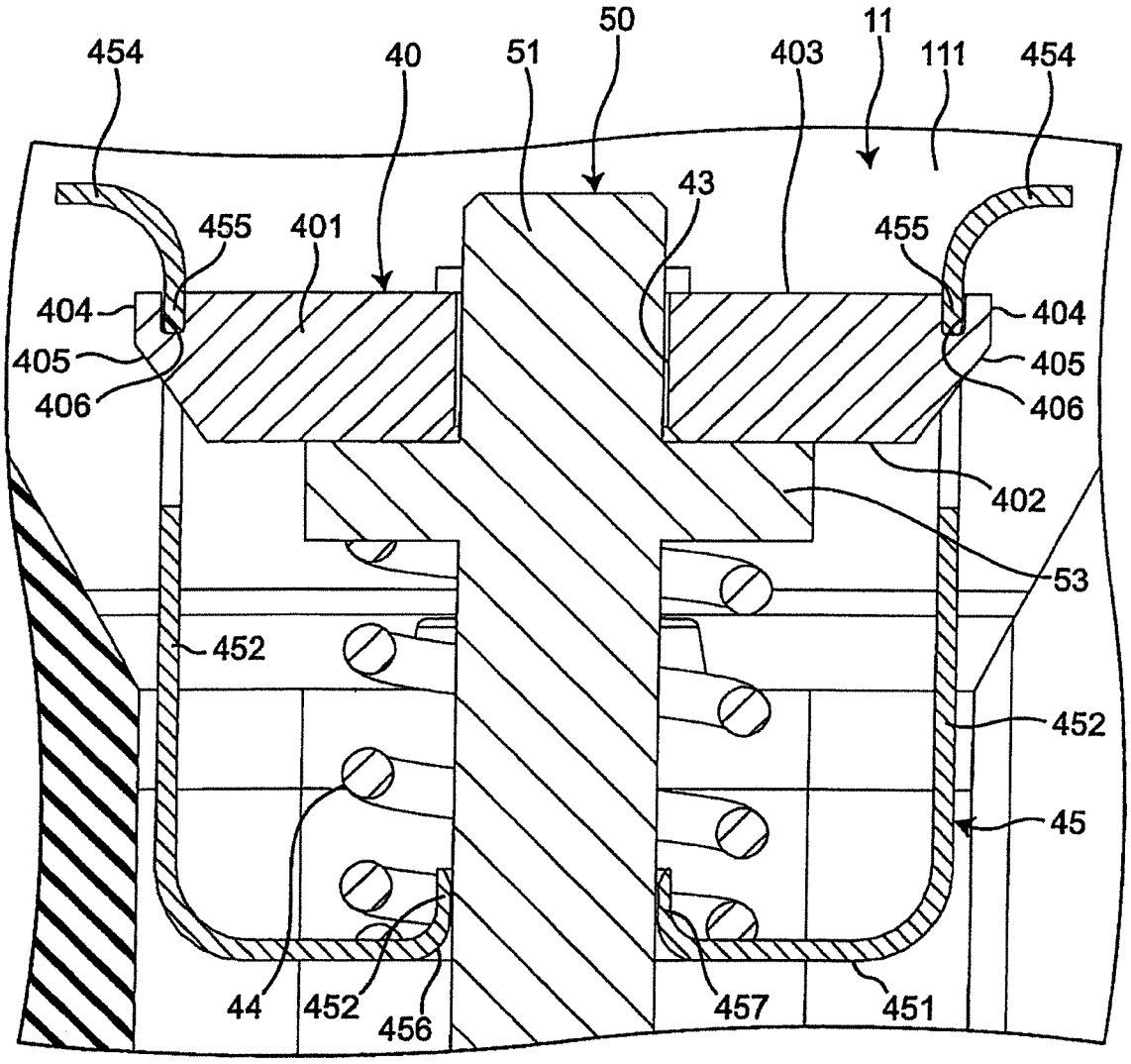
FIG. 6 is a partial magnified view of the movable contact in a cross-section along VI-VI in FIG. 1.

The contact body 401 includes hooks 404 that extend from along width ends of the contact body 401 in mutually opposite directions; the pair of connectors 452 each includes a cutout 453 which connects respectively to a hook 404. Note that only one set of hook 404 and cutout 453 is shown in FIG. 5. As illustrated in FIG. 6, the surface of the hooks 404 opposite the third wall 103 of the housing 10 in the contact movement direction are on the same plane as the second flat surface 403 of the contact body 401. The surfaces of the hooks 404 opposite the insulating wall 12 in the contact movement direction include a slanted surface 405; the slanted surface slopes closer to movable shaft 50 toward the insulating wall 12.

The slanted surfaces 405 on the hooks 404 allows the curved end 454 of the connectors 452 to contact the hooks 404 when the contact body 401 and coil spring retainer 45 are connected. Thus, the structure makes it easier to connect the contact body 401 and the coil spring retainer 45.

As illustrated in FIG. 6, the hooks 404 are provided on the surface opposite the third wall 103 in the housing 10 extending in the arrangement direction. The hooks 404 accommodate the edge 455 of the cutout 453 along the contact movement direction and include a retainer groove 406 that prevents disengagement of a hook 404 and cutout 453. More specifically, the coil spring retainer 45 is biased toward the second end 52 of the movable shaft 50 (i.e., downward in FIG. 6) via the coil spring 44 when the edge 455 of the cutout 453 sits in the retainer groove 406. Hereby, the edge 455 of the cutout 453 is restricted from slipping out of the retainer groove 406 in the hook 404 which prevents disengagement of the hook 404 and the cutout 453.

A through-hole 456 is also provided at roughly the center of the first holder 451 along the thickness thereof (FIG. 6). The peripheral edge of the through-hole 456 opposite the contact body 401 includes a rise 457. The rise 457 more reliably retains the coil spring 44 between the first holder 451 and the second holder 53.

Figure 8:
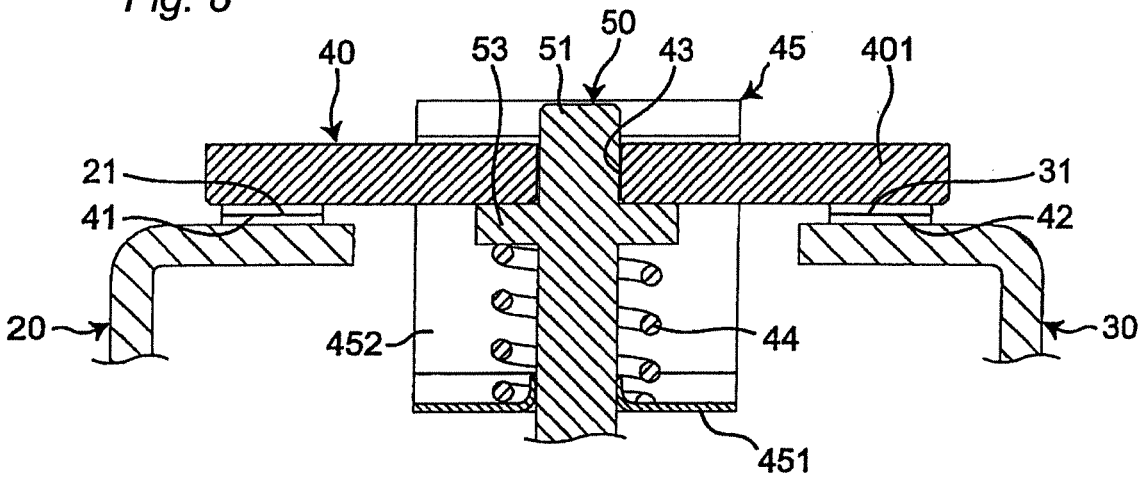
FIG. 8 is a second schematic cross-sectional view for describing the operations of the movable contact and the movable shaft in the electromagnetic relay in FIG. 1.
Figure 9:
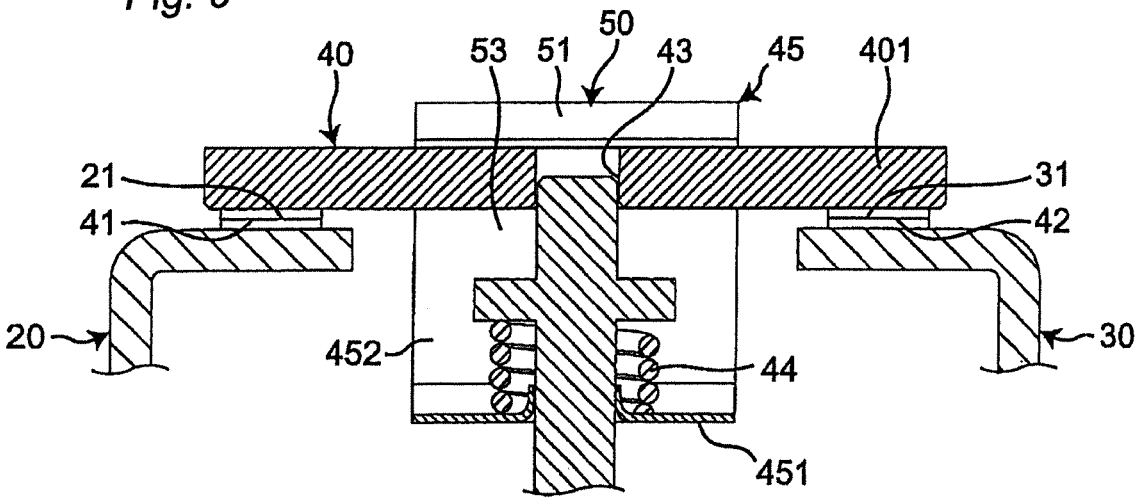
FIG. 9 is a third schematic cross-sectional view for describing the operations of the movable contact and the movable shaft in the electromagnetic relay in FIG. 1.

Next, the operations of the movable contact 40 and the movable shaft 50 are described with reference to FIGS. 7 through 9; more specifically the operations of the movable contact 40 and movable shaft 50 when the solenoid 60 moves the movable shaft 50 in the contact movement direction.

Figure 7:
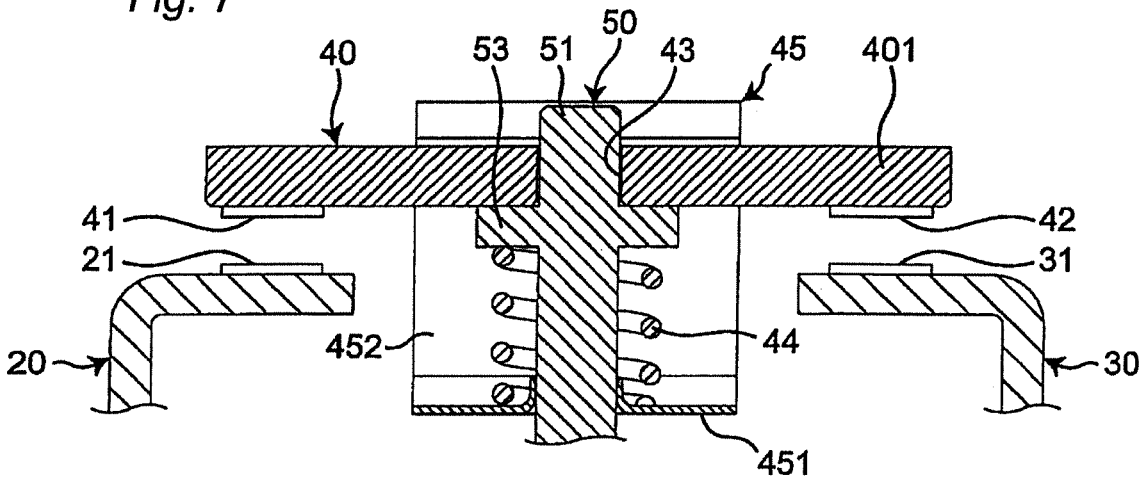
FIG. 7 is a first schematic cross-sectional view for describing the operations of the movable contact and the movable shaft in the electromagnetic relay in FIG. 1.

FIG. 7 illustrates the movable contact 40 when no current flows through the electromagnet 61. As illustrated in FIG. 7 (and similarly in FIGS. 2 and 3), the contact body 401 in the movable contact 40 is in a return position where the contact body 401 is away from the contact arrangement parts 22, 32 of the first and second fixed contact terminals 20, 30 respectively; here, the first and second movable contact points 41, 42 are separated from the first and second fixed contact points 21, 31. Note that the movable shaft 50 is assumed to be in the return position when the contact body 401 is in the return position illustrated in FIG. 7.

The movable shaft 50 travels in the contact movement direction and approaches the insulating wall 12 when the electromagnet 61 is energized; here, the contact body 401 moves with movement of the movable shaft 50 along the contact movement direction from a return position to a first operation position. In this first operation position each of the first and second movable contact points 41, 42 contact the opposing first and second fixed contact points 21, 31 (FIG. 8).

The contact body 401 stops moving in the contact movement direction toward the insulating wall 12 once the contact body 401 travels from the return position to the first operation position. In contrast, after this movement of the contact body 401 the movable shaft 50 continues to travel in the contact movement direction toward the insulating wall 12 moving to a second operation position (FIG. 9). Further movement of the movable shaft 50 toward the second operation position causes the second holder 53 to approach the first holder 451 compressing the coil spring 44. That is, the second holder 53 of the movable shaft 50 presses the coil spring 44 toward the first holder 451 in the coil spring retainer 45 when the movable shaft 50 is at the second operation position; the movable shaft 50 at this position biases the coil spring retainer 45 toward the insulating wall 12 in the contact movement direction. The biasing of the coil spring 44 also biases the contact body 401 toward the insulating wall 12 in the contact movement direction pressing the movable contact points 41, 42 toward the opposing fixed contact points 21, 31. This increases the contact pressure between the movable contact points 41, 42 and the opposing fixed contact points 21, 31.

When the electromagnet 61 is energized, the biasing of the return spring 67 causes the movable shaft 50 to move away from the insulating wall 12 in the contact movement direction (upward, FIGS. 7 through 9), and the movable shaft 50 travels from the second operation position to the return position. While the movable shaft 50 travels from the second operation position to the return position the second holder 53 comes in contact with the contact body 401, causing the contact body 401 to move away from the insulating wall 12 in the contact movement direction. That is, the contact body 401 travels from an operation position to a return position along the contact movement direction with the movement of the movable shaft 50 away from the insulating wall 12 in the contact movement direction.

In the above mentioned electromagnetic relay 1, the pair of supports 122 are each located in the first compartment 111 relative the insulating wall 12 in the housing 10; the supports 122 support the first and second fixed contact points 21, 31 in the first and second fixed contact terminals 20, 30 respectively. That is, the first and second fixed contact points 21, 31 can be accurately positioned in relation to the pair of supports 122 by simply maintaining accurate dimensions for the contact arrangement portions 22, 32 for the first and second contact terminals 20, 30 and the pair of supports 122. Therefore, the fixed contact points 21, 31 can be more easily positioned accurately in relation to the corresponding supports 122 compared to for instance, the device in Japanese Patent No. 6110109 which required accurate dimensions for the supporting conductive portions, the C-shaped portions, and the fixed contact support insulating base plate and insulating tube in the device housing.

The intermediate portions 24, 34 each include a vertical part 241, 341 that extends from the far end of the contact arrangement portion 22, 32 relative the movable shaft 50 in the arrangement direction and away from the movable contact 40 in the contact movement direction. Hereby, an electromagnetic relay 1 may be achieved which allows for easier placement of internal components by, for instance, adding a space between the housing 10 and the intermediate portions 24, 34.

An alignment part 123 is provided at the insulating wall 12 in the second compartment 112 in the housing 10 of the electromagnetic relay 1; the alignment part 123 determines the return position of the movable armature 66. That is, the movable armature 66 can be accurately positioned in relation to the housing 10 by maintaining the accuracy of the dimensions of the insulating wall 12 in the housing 10. Therefore, compared to Japanese Patent No. 6110109 where the accuracy in the dimensions or positioning of the insulating tube and the auxiliary yoke affects the return position of the movable plunger, the movable armature 66 can be very accurately positioned in the housing 10.

The alignment part 123 is also a flat surface that is a part of the housing 10 and is provided near the second compartment 112 created by the insulating wall 12. Thus, compared to Japanese Patent No. 6110109 the movable armature 66 can be very accurately positioned in the housing 10.

In the electromagnetic relay 1 the first and second fixed contact points 21, 31 are arranged in the first compartment 111 between the first and second movable contact points 41, 42 and the insulating wall 12; and the coil spring 44 is disposed between the movable contact 40 and the insulating wall 12. The first and second fixed contact terminals 20, 30 each includes: a contact arrangement portion 22, 32; an external terminal 23, 33; and an intermediate portion 24, 34. The first and second fixed contact points 21, 31 are secured to a contact arrangement portion 22, 32; the external terminal 23, 33 extends in a direction intersecting the contact movement direction to outside the housing 10. The insulating wall 12 holds the intermediate portion 24, 34 which connects the contact arrangement portion 22, 32 and the external terminal 23, 33; the intermediate portion 24, 34 curves near the second compartment 112 relative a virtual line L1, L2 connecting both ends thereof in the extension direction. That is, given there is no coil spring 44 between the movable contact 40 and the housing 10 in the contact movement direction there is, at least, no need consider how to secure space for a coil spring 44 between the movable contact 40 and the housing 10 in the contact movement direction. As a result, this uses less space between the movable contact 40 and the housing 10 in the contact movement direction, allowing the electromagnetic relay 1 to be more compact.

The pair of permanent magnets 71, 72 are located between the housing 10 and the intermediate portion 24, 34 of the first and second fixed contact terminals 20, 30 respectively; that is, the pair of permanent magnets 71, 72 are disposed so that the same are not located between the movable contact 40 and the housing 10 in the contact movement direction; this uses less of the space between the movable contact 40 and the housing 10 in the contact movement direction. The electromagnetic relay 1 may be made more compact as a result.

In the electromagnetic relay 1 the first and second fixed contact points 21, 31 are arranged in the first compartment 111 between the first and second movable contact points 41, 42 and the insulating wall 12; and the coil spring 44 is disposed between the movable contact 40 and the insulating wall 12. The movable contact 40 includes the contact body 401 and the first holder 451; the first holder 451 is between the contact body 401 and the insulating wall 12 and is connected to the contact body 401. The movable shaft 50 includes a second holder 53 located at one end 51 thereof and extending in a direction intersecting the extension direction of the movable shaft 50; the second holder 53 retains the first holder 451 together with the coil spring 44. In other words, there is no need to arrange a coil spring 44 between the movable contact 40 and the housing 10 in the contact movement direction; this uses less of the space between the movable contact 40 and the housing 10 in the contact movement direction. The electromagnetic relay 1 may be made more compact as a result.

The contact body 401 and the first holder 451 are connected via a pair of plate-like connectors 452; when viewed from the contact movement direction, each connector 452 appears to extend in the contact movement direction from the end along the width of the contact body 401 toward the insulating wall 12 with the flat surfaces thereof mutually parallel. Note that the width direction of the contact body 401 intersects with the arrangement direction which connects the first and second movable contact points 41, 42. The pair of connectors 452 allows the contact body 401 and the first holder 451 to be connected via a simple construction and therefore facilitates realizing a compact electromagnetic relay 1.

The first holder 451 and the pair of connectors 452 are also provided separately from the contact body 401. The contact body 401 includes hooks 404 that extend from along the width ends thereof in mutually opposite directions; the pair of connectors 452 each includes a cutout 453 that connects to a hook 404. The hooks 404 and cutouts 453 provide a reliable connection between the first holder 451 and the connectors 452 and therefore facilitate realizing a compact electromagnetic relay 1.

The hooks 404 extend in the arrangement direction and include a retainer groove 406 that accommodates the edge 455 of a cutout 453 and prevents the hook 404 from disengaging from the cutout 453. The retainer groove 406 provides a more reliable connection between the first holder 451 and the connectors 452 and therefore facilitates realizing a compact electromagnetic relay 1.

The contact body 401 is also provided with a connection hole 43 that allows the one end 51 of the movable shaft 50 to be inserted and to travel in the contact movement direction. The connection hole 43 provides a more stable position for the movable shaft 50 relative to the movable contact 40 and thus improves the operating characteristics of the electromagnetic relay 1.

A bus bar 90 (FIG. 2) may be provided to the first fixed contact terminal 20 or second fixed contact terminal 30 extending in the arrangement direction outside the housing 10 along the third wall 103; this is one possible method of improving the contact reliability of the electromagnetic relay 1. With this method the current through the movable contact 40 and the current through the bus bar 90 flow in mutually opposite directions. Therefore, the electromagnetic repulsion generated due to the currents in the movable contact 40 and the bus bar 90 presses the movable contact points 41, 42 in the movable contact 40 against the opposing fixed contact points 21, 31 and increase the contact pressure between the movable contact points 41, 42 and the fixed contact points 21, 31. The contact reliability of the electromagnetic relay 1 increases as a result.

The electromagnetic repulsion generated due to the currents flowing in the movable contact 40 and the bus bar 90 increases as the movable contact 40 and bus bar 90 approach each other. There is no need to arrange a coil spring 44 between the movable contact 40 and the housing 10 in the contact movement direction; this uses less of the space between the movable contact 40 and the housing 10 in the contact movement direction in the electromagnetic relay 1. The contact device in Japanese Patent No. 6110109 contains a pair of fixed contacts and a contact spring located between the movable contact and the housing; in contrast, the distance between the movable contact 40 and the bus bar 90 may be reduced to increase the electromagnetic repulsion generated due to the current flowing in the movable contact 40 and the bus bar 90. In other words, an electromagnetic relay 1 with greater contact reliability may be realized compared to the contact device in Japanese Patent No. 6110109.

Figure 10:
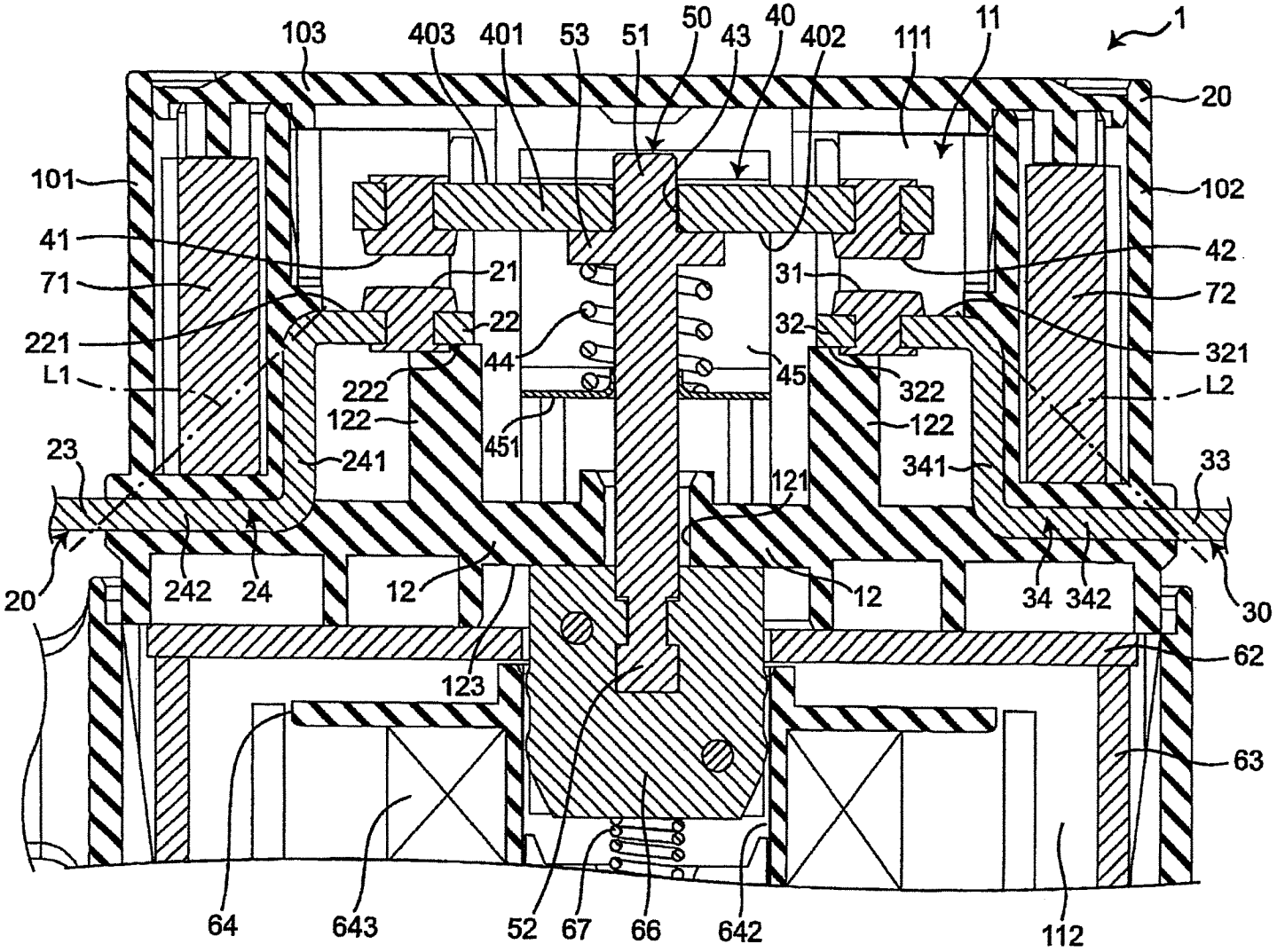
FIG. 10 is a magnified cross-sectional view of the first compartment depicting a first example of modifying the electromagnetic relay in FIG. 1.

Note that the pair of supports 122 is not limited to supporting almost the entire the support surfaces 222, 322 of the contact arrangement portions 22, 32. For example, as illustrated in FIG. 10, the pair of supports 122 may be configured to support the first and second fixed contact points 21, 31 via the far ends of the contact arrangement portions 22, 32 away from the intermediate portions 24, 34 in the arrangement direction (i.e., the support surfaces 222, 322 at the ends of the contact arrangement portions 22, 32 close to the movable shaft 50. This reduces the space the supports 122 take up in the first compartment 111, and thus provides an electromagnetic relay 1 where the layout is easier to design.

Figure 11:
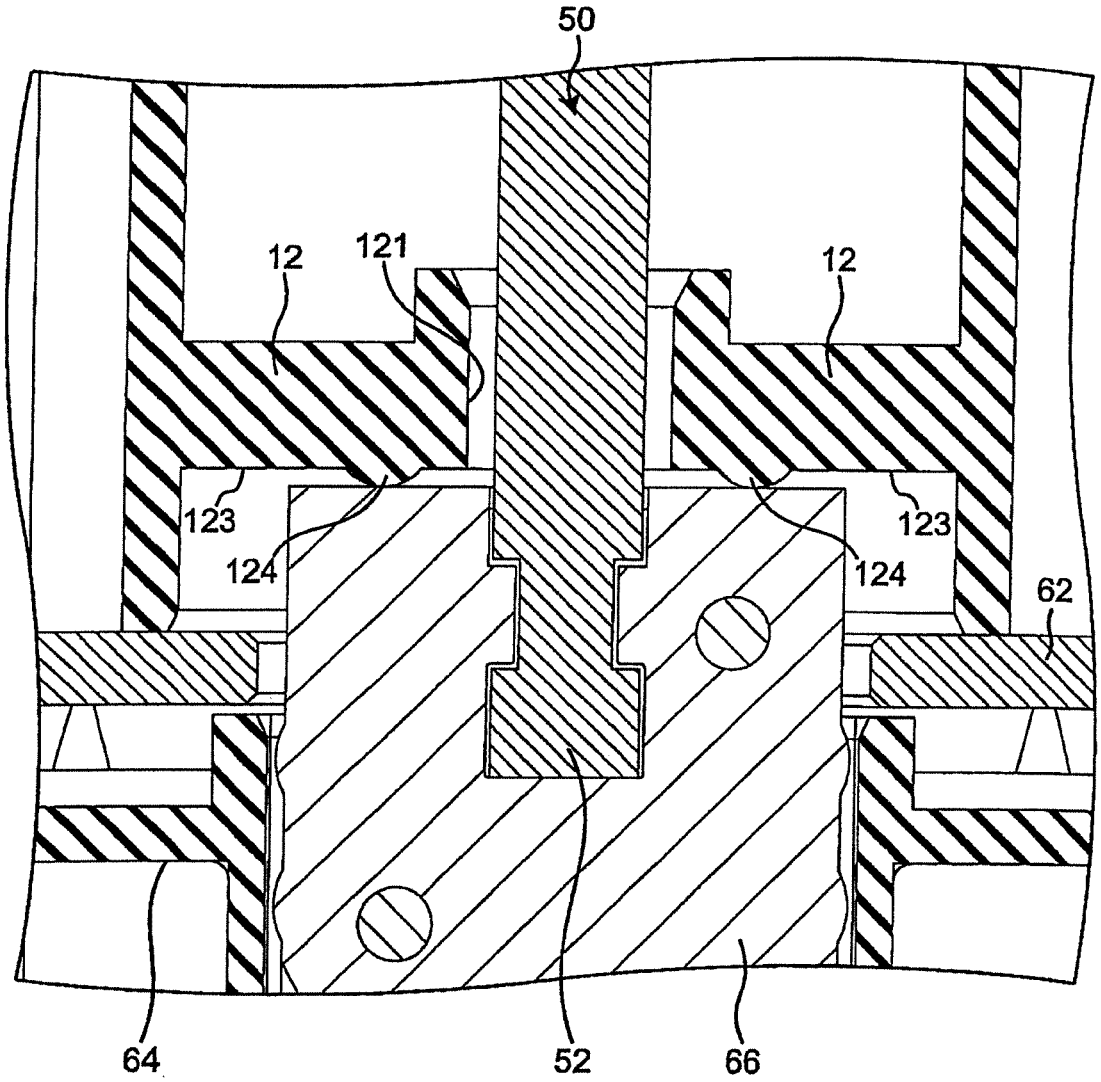
FIG. 11 is a magnified cross-sectional view of the movable armature depicting a second example of modifying the electromagnetic relay in FIG. 1.

The alignment part 123 is not limited to a flat surface that is a part of the housing 10 and is provided near the second compartment 112 created by the insulating wall 12. For instance, the alignment part 123 may be all or a part of a corrugated surface. The alignment part 123 may also include a positioning bump 124 (FIG. 11) that protrudes from the insulating wall 12 along the contact movement direction toward the movable armature 66 and that touches the movable armature 66 at the return position of the movable armature 66. Thus, a positioning bump 124 may be provided on the alignment part 123 to more exactly define where the alignment part 123 touches the movable armature 66. The positioning bump 124 may be a single round bump at the edge of the through-hole 121, or a plurality of bumps provided at predefined intervals surrounding the through-hole 121 (e.g., three bumps provided at 120°). Note that a positioning bump 124 may be provided on the movable armature 66 instead of on the alignment part 123; the positioning bump may be provided on the movable armature 66 extending therefrom toward the insulating wall 12 in the contact movement direction; in this case the positioning bump contacts the alignment part 123 when the movable armature 66 is at the return position.

Figure 12:
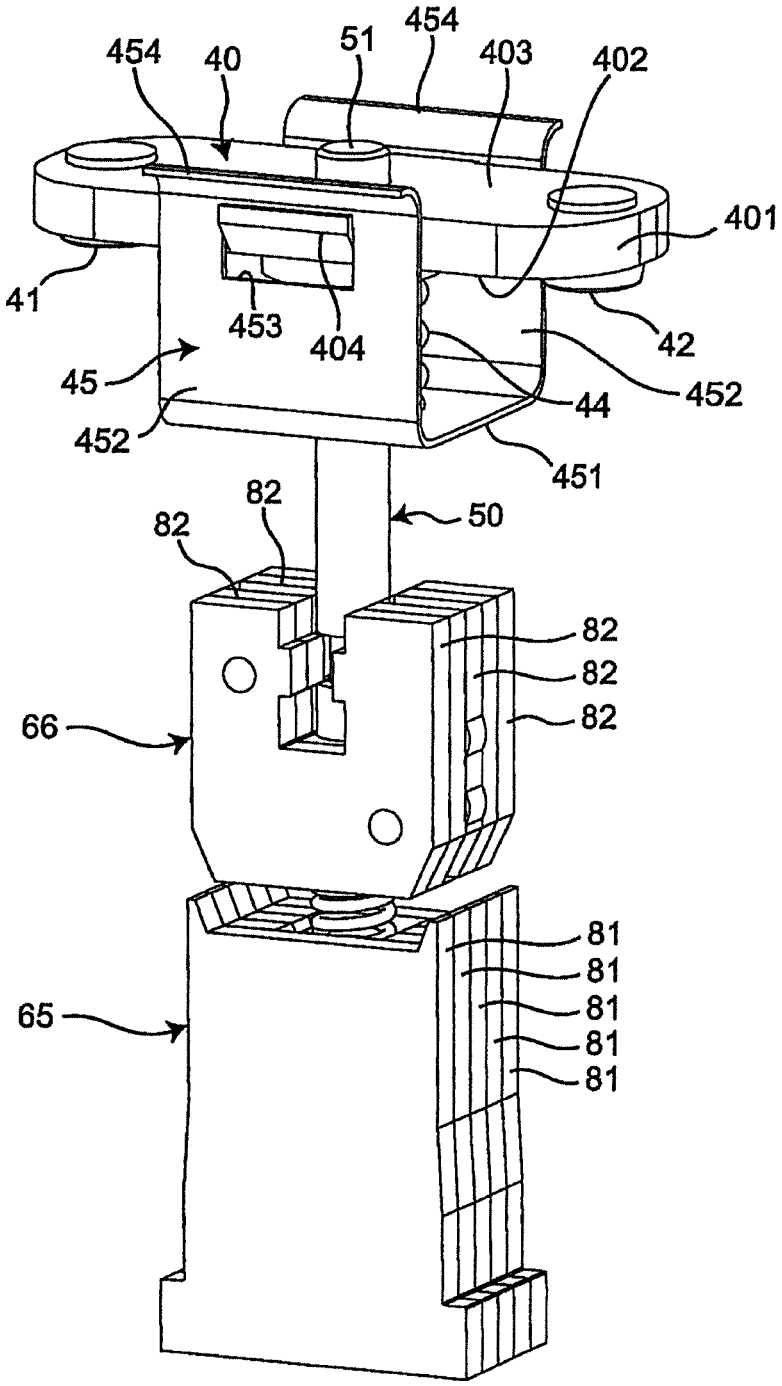
FIG. 12 is a perspective view of the movable contact, movable shaft, movable armature, and fixed armature depicting a third example of modifying the electromagnetic relay in FIG. 1.

The fixed armature 65 and the movable armature 66 may be made up of a plurality of laminations 81, 82 which are flat plates layered in the thickness direction of the armatures (FIG. 12); the fixed armature 65 and the movable armature 66 may be made up of a single piece of magnetic material. For instance, it tends to be easier to ensure that the first compartment 111 and the second compartment 112 are fluidly connected when the movable armature 66 is made up of a plurality of laminations 82, even when the movable armature 66 is in contact with the alignment part 123. That is, an electromagnetic relay 1 thusly configured has greater design flexibility.

The intermediate portions 24, 34 of the first and second fixed contact terminals 20, 30 may be connected to the contact arrangement portions 22, 32 and the external terminal 23, 33 and held in the housing 10; however, an intermediate portion 24, 34 is not limited to an L-shape and is not limited to curving at one location near the second compartment 112 relative a virtual line L1, L2 that connects both ends in the extension direction thereof. For example, the intermediate portions 24, 34 may connect the contact arrangement portions 22, 32 and the external terminal 23, 33 directly; as illustrated in FIG. 13, the intermediate portions 24, 34 may curve at multiple locations relative to a virtual line L1, L2 connecting both ends thereof in an extension direction (e.g., two locations in FIG. 13).

Figure 13:
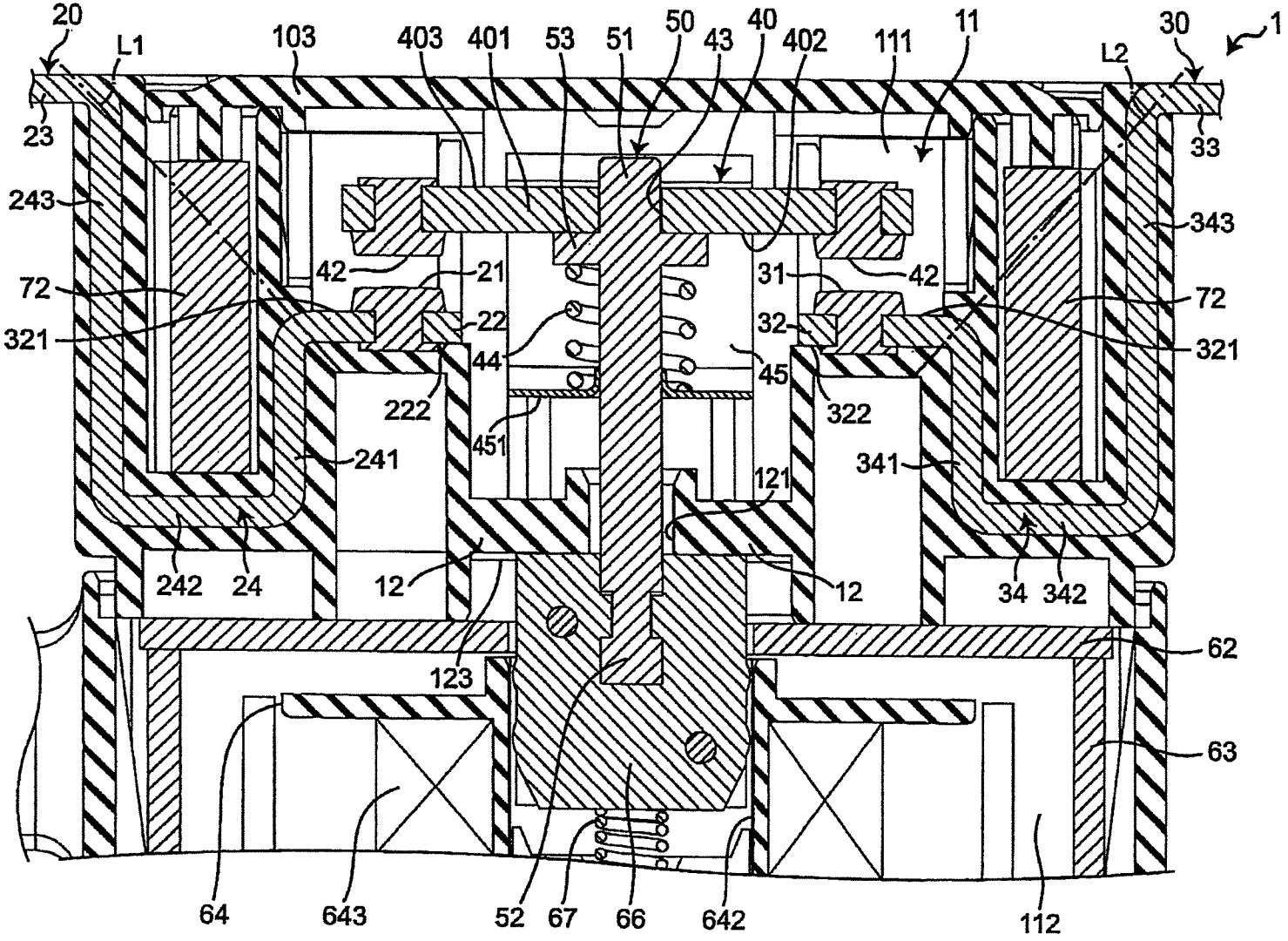
FIG. 13 is a magnified cross-sectional view of the first compartment depicting a fourth example of modifying the electromagnetic relay in FIG. 1.

The intermediate portions 24, 34 of the fixed contact terminals 20, 30 in FIG. 13 are made up of a first vertical part 241, 341, a horizontal part 242, 342, and a second vertical part 243, 343. The vertical parts 241, 341 extend from the far end of the contact arrangement portions 22, 32 relative the movable shaft 50 in the arrangement direction and away from the movable contact 40 in the contact movement direction. The horizontal part 242, 342 extends from the far end of the vertical part 241, 341 relative the movable contact 40 in the contact movement direction and away from the movable shaft 50 in the arrangement direction. The second vertical part 243, 343 extends from the far end of the horizontal part 242, 342 relative the contact arrangement portions 22, 32 in the arrangement direction toward the movable contact 40 in the contact movement direction and connects to the external terminal 23, 33. In FIG. 13 the external terminal 23, 33 is located further away from the second compartment 112 than the contact arrangement portion 22, 32 in the contact movement direction.

At least a portion of the intermediate portions 24, 34 may be retained in the housing 10; the intermediate portions 24, 34 are not limited being retained entirely in the housing 10.

The pair of permanent magnets 71, 72 are not limited to sandwiching the movable contact 40 in the arrangement direction (i.e., along the length of when viewing the movable contact 40 from the contact movement direction). The pair of permanent magnets 71, 72 may be omitted depending on the design of the electromagnetic relay 1; and, for instance, the pair of permanent magnets 71, 72 may sandwich the movable contact 40 in the transverse direction when viewing the movable contact 40 from the contact movement direction.

The movable contact 40 and the coil spring retainer 45 are not limited to being provided as separate materials in relation to the contact body 401. The contact body 401, the first holder 451, and the pair of connectors 452 may be integrally formed.

The coil spring retainer 45 is also not limited to appearing U-shaped when viewed along the length of the contact body 401.

The contact body 401 and the coil spring retainer 45 are not limited to being connected by engaging hooks 404 with cutouts 453; the contact body 401 and the coil spring retainer 45 may be connected via another method in accordance with the design of the electromagnetic relay 1.

The retainer groove 406 may be omitted in accordance with the design, or the like of the electromagnetic relay 1.

The connection hole in the movable contact 40 is not limited to the through-hole 43 passing through the thickness of the contact body 401; the connection hole may be any desired form so long as the same allows one end 51 of the movable shaft 50 (i.e., the first end 51) to move relatively in the thickness direction of the contact body 401. That is, a blind hole may be provided instead of a through-hole 43 in the second flat surface 403 of the contact body 401 to allow the one end 51 of the movable shaft 50 to connect to and move relatively in the contact movement direction.

Note that the contact body 401 and the one end 51 of the movable shaft 50 are not limited to connection via the connection hole. For example, the movable shaft 50 may be secured to the contact body 401 to connect the contact body 401 and the one end 51 of the movable shaft 50.

The present disclosure is not limited to an electromagnetic relay 1 where the direction the movable contact 40 approaches the solenoid 60 and the direction the movable contact points 41, 42 contact the corresponding fixed contact points 21, 31 are the same. The present disclosure also applies to electromagnetic relays 1 where the direction the movable contact 40 approaches the solenoid 60 and the direction the movable contact points 41, 42 contact the corresponding fixed contact points 21, 31 are different.

Here ends the description of various working embodiments of the invention with reference to the drawings. Lastly, various other aspects of the present invention are described. As an example, the following description includes reference numerals.

A first embodiment of an electromagnetic relay 1 includes:

a housing 10 including a first compartment 111 and a second compartment 112 mutually separated by an insulating wall 12;

a first fixed contact terminal 20 secured to the housing 10 and extending from outside the housing 10 to the first compartment 111, the first fixed contact terminal 20 including a first fixed contact point 21 in the first compartment 111;

a second fixed contact terminal 30 secured to the housing 10 and extending from outside the housing 10 to the first compartment 111, the second fixed contact terminal 30 electrically isolated from the first fixed contact terminal 20 and including a second fixed contact point 31 in the first compartment 111;

a movable contact 40 arranged in the first compartment 111, and including a first movable contact point 41 and a second movable contact point 42, the first and second movable contact points 41, 42 facing the first and second fixed contact points 21, 31 which are arranged between the first and second movable contact points 41, 42 and the insulating wall 12; the first and second movable contact points 41, 42 configured to travel in a contact movement direction in which the first and second movable contact points 41, 42 make contact with and separate from the first and second fixed contact points 21, 31;

a movable shaft 50 extending from the first compartment 111 to the second compartment 112 in the contact movement direction with one end 51 in the extension direction arranged in the first compartment 111 and the other end in the extension direction arranged in the second compartment 112 via a through-hole 121 that passes through the insulating wall 12 in the contact movement direction, the one end 51 in the extension direction connected to the movable contact 40 in the first compartment 111 and configured to travel together with the movable contact 40 in the contact movement direction; and a solenoid 60 in the second compartment 112 configured to drive the movable shaft 50 in the contact movement direction;

the solenoid 60 including:

a spool 64 that includes: a through-hole 642 extending in the contact movement direction and accommodating the other end 52 of the movable shaft 50, a coil 643, and a drum 641 with the coil wrapped around the drum 641 in the contact movement direction;

a fixed armature 65 secured in the through-hole 642 to the far end of the through-hole 642 relative to the insulating wall 12 in the contact movement direction;

a movable armature 66 arranged in the through-hole 642 between the fixed armature 65 and the insulating wall 12 and attached to the other end 52 of the movable shaft 50, the movable armature 66 configured to travel with the movable shaft 50 in the contact movement direction between an operation position and a return position;

the housing 10 including:

an alignment part 123 provided in the second compartment 112 at the insulating wall 12, the alignment part 123 determining the return position of the movable armature 66.

An alignment part 123 is provided at the insulating wall 12 in the second compartment 112 in the housing 10 of the electromagnetic relay 1; the alignment part determines the return position of the movable armature 66. That is, the movable armature 66 can be accurately positioned in relation to the housing 10 by maintaining the accuracy of the dimensions of the insulating wall 12 in the housing 10. Therefore, compared to Japanese Patent No. 6110109 where the accuracy in the dimensions or positioning of the insulating tube and the auxiliary yoke also affects the return position of the movable plunger, the movable armature 66 can be very accurately positioned in the housing.

In a second embodiment of the electromagnetic relay 1, the alignment part 123 is provided as a part of the housing 10 as a flat surface in the second compartment 112 on the insulating wall 12.

Thus, in the electromagnetic relay 1 according to the second embodiment, the movable armature 66 can be very accurately positioned in the housing 10 compared to in the contactor device in Japanese Patent No. 6110109.

In a third embodiment of the electromagnetic relay 1:

the alignment part 123 includes a positioning bump 124 that protrudes from the insulating wall 12 in the contact movement direction toward the movable armature 66 and touches the movable armature 66 when the movable armature 66 is at the return position.

Thus, in the electromagnetic relay 1 according to the third embodiment, a positioning bump 124 may be provided on the alignment part 123 to more exactly define where the alignment part 123 touches the movable armature 66.

In a fourth embodiment of the electromagnetic relay 1:

the movable armature 66 is made up of a plurality of laminations 82 layered in a direction intersecting the contact movement direction.

For instance, in the electromagnetic relay 1 according to the fourth embodiment, it tends to be easier to ensure that the first compartment 111 and the second compartment 112 are fluidly connected when the movable armature 66 is made up of a plurality of laminations 82, even when the movable armature 66 is in contact with the alignment part 123. That is, an electromagnetic relay 1 thusly configured has greater design flexibility.

Note that the various above-described embodiments and modification examples may be combined as appropriate to obtain the results thereof. Additionally, the embodiments, working examples, or embodiments and example modifications may be combined; however, different embodiments and working examples with similar features may also be combined.

INDUSTRIAL APPLICABILITY

The electromagnetic relay according to the embodiment may be adopted in an electric vehicle.

The invention claimed is:

1. An electromagnetic relay comprising: a housing including a first compartment and a second compartment mutually separated by an insulating wall;

a first fixed contact terminal secured to the housing and extending from outside the housing to the first compartment, the first fixed contact terminal including a first fixed contact point in the first compartment;

a second fixed contact terminal secured to the housing and extending from outside the housing to the first compartment, the second fixed contact terminal electrically isolated from the first fixed contact terminal and including a second fixed contact point in the first compartment;

a movable contact arranged in the first compartment, and including a first movable contact point and a second movable contact point, the first and second movable contact points facing the first and second fixed contact points which are arranged between the first and second movable contact points and the insulating wall; the first and second movable contact points configured to travel in a contact movement direction in which the first and second movable contact points make contact with and separate from the first and second fixed contact points;

a movable shaft extending from the first compartment to the second compartment in the contact movement direction with one end in the extension direction arranged in the first compartment and the other end in the extension direction arranged in the second compartment via a through-hole that passes through the insulating wall in the contact movement direction, the one end in the extension direction connected to the movable contact in the first compartment and configured to travel together with the movable contact in the contact movement direction; and a solenoid in the second compartment configured to drive the movable shaft in the contact movement direction;

the solenoid including:

a spool that includes: a through-hole extending in the contact movement direction and accommodating the other end of the movable shaft, a coil, and a drum with the coil wrapped around the drum in the contact movement direction;

a fixed armature secured in a second through-hole to the far end of the second through-hole relative to the insulating wall in the contact movement direction;

a movable armature arranged in the second through-hole between the fixed armature and the insulating wall and attached to the other end of the movable shaft, the movable armature configured to travel with the movable shaft in the contact movement direction between an operation position and a return position;

the housing including:

an alignment part provided in the second compartment at the insulating wall, the alignment part determining the return position of the movable armature, wherein the alignment part includes a positioning bump, the positioning bump being a plurality of bumps that each protrude from the insulating wall in the contact movement direction toward the movable armature and each touch the movable armature when the movable armature is at the return position.

2. The electromagnetic relay according to claim 1, wherein the movable armature is made up of a plurality of laminations layered in a direction intersecting the contact movement direction.

* * * * *